US006286723B1

(12) United States Patent
Sweeton et al.

(10) Patent No.: US 6,286,723 B1
(45) Date of Patent: Sep. 11, 2001

(54) SELF-RESETTING CHILD-RESISTANT TRIGGER SPRAYER

(75) Inventors: Steve L. Sweeton; William L. Driskell, both of Lee's Summit, MO (US); Pedro Parés Montaner, Barcelona (ES)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/519,664

(22) Filed: Mar. 6, 2000

(51) Int. Cl.[7] ..... B67D 5/38
(52) U.S. Cl. ..... 222/153.13; 222/384
(58) Field of Search ..... 222/153.13, 383.1, 222/384

(56) References Cited

U.S. PATENT DOCUMENTS

| | | |
|---|---|---|
| 3,927,834 | 12/1975 | Tada . |
| 4,346,821 | 8/1982 | Wesner et al. . |
| 4,373,644 | 2/1983 | Bennett . |
| 4,441,633 | 4/1984 | Bennett . |
| 4,506,805 | 3/1985 | Marcon . |
| 4,516,695 | 5/1985 | Garneau . |
| 4,946,074 | 8/1990 | Grogan . |
| 5,050,779 | 9/1991 | Knicknerbocker . |
| 5,114,049 | 5/1992 | Knicknerbocker . |
| 5,228,600 | 7/1993 | Steijns et al. . |
| 5,482,186 | 1/1996 | Rodden, Jr. . |
| 5,535,952 | 7/1996 | Tada . |
| 5,560,545 | 10/1996 | Grogan et al. . |
| 5,564,604 | 10/1996 | Tada . |
| 5,687,880 | 11/1997 | Maas et al. . |
| 5,722,569 | 3/1998 | Foster . |
| 6,003,738 * | 12/1999 | Foster et al. ..... 222/384 |
| 6,006,950 * | 12/1999 | Watanabe et al. ..... 222/384 |

FOREIGN PATENT DOCUMENTS

9299838 * 11/1997 (JP) .

* cited by examiner

*Primary Examiner*—Philippe Derakshani
(74) *Attorney, Agent, or Firm*—Dykema Gossett PLLC

(57) ABSTRACT

A self-resetting child-resistant trigger sprayer having a lock slidingly mounted on the trigger lever for locking the trigger sprayer. The lock has a pair of extensions, a biasing member and a projection that all extend away from the main portion of the body of the lock. The extensions engage a portion of the trigger sprayer and the biasing member provide a restoring force that enables the trigger sprayer to be self-resetting. The projection is capable of being moved by the operator of the sprayer along the trigger lever. When in a raised position, the extensions disengage from a portion of the body of the sprayer placing the sprayer in an unlocked position. However, when the projection is released, the extensions engage a portion of the piston cylinder preventing the piston cylinder from moving and the biasing member automatically force the lock into a lower, locked position on the trigger lever thus rendering the sprayer self-resetting and child-resistant.

15 Claims, 2 Drawing Sheets

SELF-RESETTING CHILD-RESISTANT TRIGGER SPRAYER

BACKGROUND OF THE INVENTION

This invention relates generally to a manually operated fluid trigger sprayer and more particularly to a trigger sprayer having a locking means slidingly mounted on the trigger lever that automatically resets itself in a position that locks the trigger lever against actuation.

There is a need for manually operated pump sprayers to be rendered child-resistant so as to help prevent unauthorized dispensing of a product from the pump sprayer. A pump can be made child-resistant by including a locking mechanism on the pump that prevents the pumping operation. There is a need for child-resistant pump sprayers in various applications, such as when the pump sprayers contain poisonous insecticides or hazardous materials. Various mechanisms have been developed to lock sprayers and prevent user's from actuating them.

One common solution to making a sprayer child-resistant is to lock the discharge nozzle of the sprayer to prevent discharge of fluids. The locking of the discharge nozzle has been achieved through various means such as those found in U.S. Pat. Nos. 4,346,821; 4,516,695; 5,050,779; 5,228,600 and 5,482,186. A drawback to the solutions developed in these patents is that once the nozzle has been unlocked, the sprayer may be used and the sprayer is no longer child-resistant. The sprayer is not child-resistant unless the nozzle is placed in the locked position once again.

Another solution developed to make sprayers child-resistant is to lock the trigger lever and thereby prevent it from actuating the pump cylinder in a sprayer. Currently in the art, a number of different mechanisms have been developed that lock the trigger lever, examples of which are illustrated in U.S. Pat. Nos. 3,927,834; 4,373,644; 4,441,633 and 4,946,074. As with the previous patents, when the sprayers in these patents are in the unlocked position, they are easily accessible regardless whether the user is a child or not. Thus, in the unlocked position, these sprayers in the art are not child-resistant until or unless they are placed in a locked position.

In neither situation previously identified, when the nozzle is locked or when the trigger lever is locked, is the locking mechanism of the sprayer self-resetting. Primarily in the art, manually operated sprayers must deliberately be placed into a locked or unlocked position, and the sprayer will remain in that specific position until it is placed in a different position. The sprayers will not automatically reset themselves into a locked position after every use.

The Knickerbocker patent, U.S. Pat. No. 5,114,049, presents a child-resistant trigger sprayer that is also self-resetting. This particular device has a latch pivotally mounted on the trigger lever for preventing trigger actuation. The latch has an arm projecting forwardly of the trigger lever to facilitate pivotal movement of the latch against the bias of a spring for unlocking the trigger lever and permit pumping. The latch in this invention is automatically returned to its locking position at the end of each pumping operation. However, for this device, a special trigger lever must be manufactured. The locking mechanism cannot be used in conjunction with trigger levers already existing in the art.

There exists a need in the art for an improvement of the existing child-resistant trigger sprayers given the limitations of the existing art.

It is possible to make a sprayer child-resistant by requiring a two-step action be performed in order to operate the sprayer, such as lifting up on a tab while simultaneously pulling the trigger lever, as is shown in the present invention. This renders the sprayer child-resistant because children under a certain age generally cannot perform both functions simultaneously that are necessary to operate the trigger sprayer. The existence of spring-biased arms also allows for the trigger lever to be automatically returned to a locked position after every use. One embodiment of the present invention may also be used with trigger levers currently known in the art, making the locking mechanism economical as well as easy to use.

SUMMARY OF THE INVENTION

It is an object of the present invention to provide a child-resistant trigger actuated sprayer wherein a lock is attached to the trigger lever so as to render the trigger lever easily operable by an adult yet difficult for a child to operate and will automatically reset itself into the locked position when not in use.

One embodiment of the lock can be used with trigger levers common in the marketplace and both embodiments are economical, easy to mass produce and assemble yet highly effective.

According to the first embodiment of the invention, the locking means comprises a lock slidably mounted on a trigger lever that is currently standard in the industry, thus avoiding the added cost of trigger lever production. The lock has a body with a front portion, a rear portion, side portions, biasing means and a pair of extensions extending from the main portion of the body. Opposite the extensions is a projection or tab that extends away from the main portion of the body for movement by the operator of the sprayer.

The second embodiment of the invention comprises a lock that is also slidably mounted on a modified trigger lever provided with two slots through which the lock is slidably mounted. The lock is comprised of a body having a front portion, a rear portion and side portions. The lock also has extensions and arcuate resilient arms extending from the main portion of the body. A projection extends away from the main portion of the body, in the opposite direction as the extensions that allows for the manipulation of the lock.

Other objects, advantages and novel features of the invention will become more apparent from the following detailed description of the invention when taken in conjunction with the accompanying drawings.

DETAILED DESCRIPTION OF THE INVENTION

Figure 1:
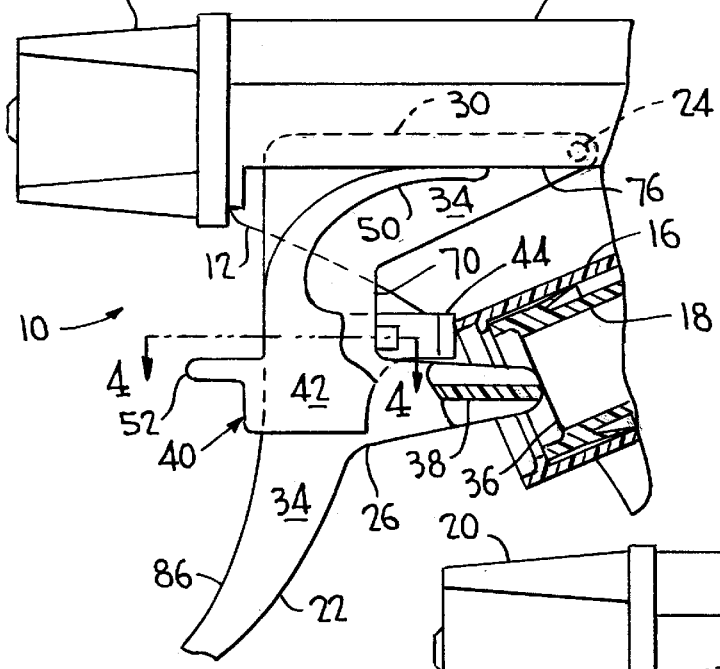
FIG. 1 is a partial side elevational view, partly broken-away, of a first embodiment of a self-resetting child-resistant trigger sprayer according to the invention with the trigger lever being shown in a locked position.

Referring to FIG. 1, the trigger sprayer 10 has a pump body 12 including a pump mechanism comprising a pump piston 18 and a pump cylinder 16. The pump piston 18 reciprocates within pump cylinder 16 and therewith defines a variable volume pump chamber as well known in the art. The pump body 12, which may be covered by a shroud 14, is adapted to be mounted on a container (not shown), in a manner similar to that disclosed in U.S. Pat. No. 5,114,049.

Figure 4:
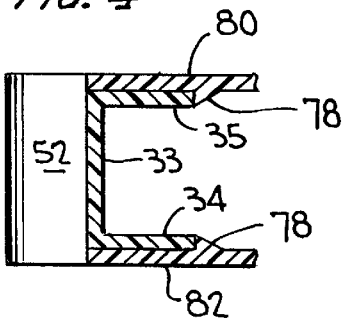
FIG. 4 is a cross-sectional view of the lock on the trigger lever of the first embodiment of a self-resetting child-resistant trigger sprayer taken along line 4—4 of FIG. 1.

The trigger lever 22 is hingedly mounted to the pump body 12 with a hinge 24 at hinged end 30 of the trigger lever 22 and rotates about the hinge axis when operated by the user in a known manner. The trigger lever 22 is substantially U-shaped in cross-section (FIG. 4) and has a pair of spaced side walls 34,35 and a front wall 33, the side walls extend from hinged end 30 to the opposing free end of the trigger lever 22 with a tup or extension 26 projecting rearwardly from each side wall 34,35. The trigger lever 22 has a finger engaging front surface 86.

Extensions 26 engage a confronting portion of a piston rim 36 of the pump piston 18 as in the normal manner to facilitate manual reciprocation of the piston during each pull of the trigger lever 22 to thereby expel liquid product from the pump chamber through the discharge orifice (not shown).

Figure 2:
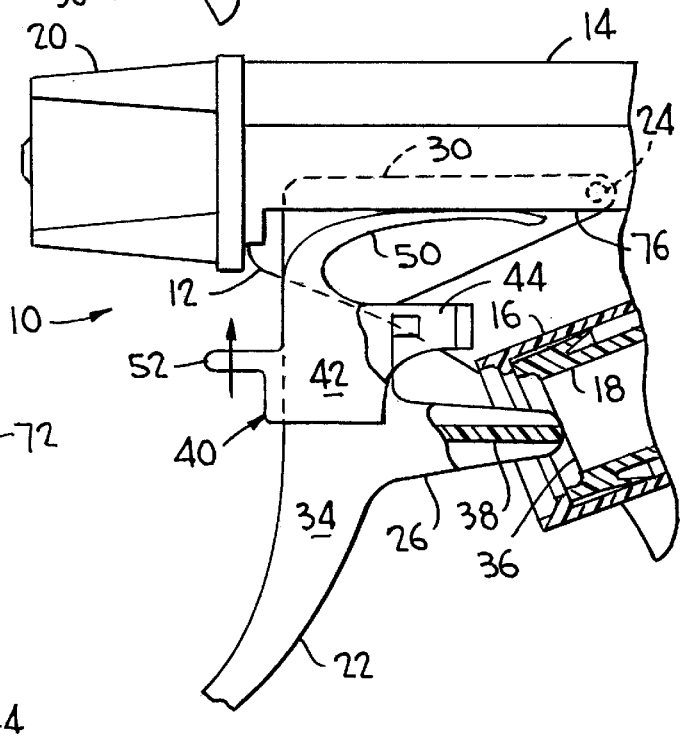
FIG. 2 is a view similar to the view of FIG. 1, with the trigger lever being shown in an unlocked position.

The lock 40 slidingly engages the trigger lever 22 and is capable of maintaining the trigger lever 22 in a locked position preventing operation of the sprayer 10 as shown in FIG. 1. When the lock 40 is moved to a raised position, as shown in FIG. 2, the sprayer 10 is placed in an unlocked position.

Figure 3:
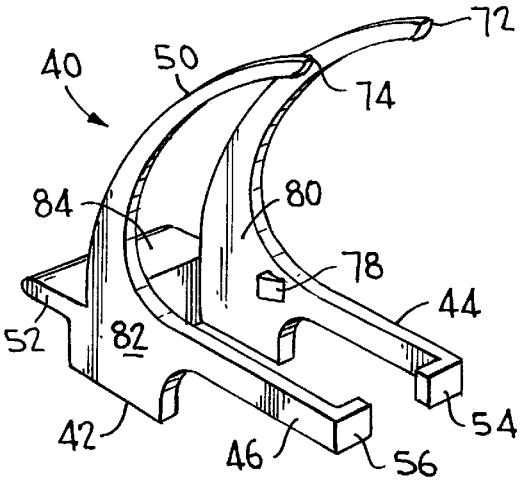
FIG. 3 is a perspective view of the lock illustrated in the FIG. 1 embodiment.

As shown in FIG. 3, the lock 40 is comprised of a body 42 with a front portion, a rear portion and side portions and having a pair of parallel extensions 44,46 projecting rearwardly from the body 42. The extensions terminate in inward projections 54,56 provided to abut the end of a confronting portion of the pump cylinder 16 when the lock 40 is placed in the inoperable position on the sprayer 10 as shown in FIG. 1. Projections 54,56 clear the end of the confronting portion of the pump cylinder 16 when the sprayer 10 is placed in the operable position as shown in FIG. 2.

The lock 40 also has a biasing means comprised of spring-biased arcuate resilient arms 48,50 that extend in an upward direction from the body 42. Each of the arcuate resilient arms 48,50 has a corresponding free end 72,74 bearing against a shoulder 76 of the body 12 defined by a lower edge of the shroud 14. Otherwise, pump body 12 could be provided with a shoulder 76 if no shroud such as shroud 14 is used.

Opposite the extensions 44,46 is a projection or a tab 52 that extends in a forward direction opposite the extensions 44,46. The projection 52 is capable of being manually manipulated when the sprayer 10 is in operation and moves in an up-and-down motion if the container (not shown) is held in an upright position.

On the inside of the body 42 of the lock 40, is a pair of retainer projections 78 that extend out from the inside of each side portion 80,82 of the body 42 opposite one another. Each retainer projection 78 is used to snap-lock the lock 40 onto the trigger lever 22. The lock 40 is slid onto the trigger lever 22 until the finger engaging front surface 86 of the trigger lever 22 bears against the forward portion 84 of the lock 40. Each retainer projection 78 then abuts against the rear sidewall edge 68,70 of each sidewall 34,35 of the trigger lever 22 preventing the trigger lever 22 from moving in a back-and-forth motion within the lock 40 itself. In the first embodiment, each retainer projection 78 abuts the tup or extension 26 thereby retaining the lock 40 in position on the trigger lever 22 so the extensions 44,46 remain in a position above the tup or extension 26. When the lock 40 is in the locked position, as shown in FIG. 1, the biasing means may have some initial bias. If this is the case, then the retainer projections 78 may help to retain the lock 40 in a position wherein the biasing means is in a slightly biased position. By having a slight force acting in the biasing means could help prevent rattles and keep the lock 40 in a tight position.

All the aforedescribed elements of the lock 40 are integrally formed to provide a single, one-piece structure that is durable, flexible and strong.

In the locked position, as shown in FIG. 1, the projection 52 is pushed upwardly (arrow in FIG. 2), raising the lock 40, which moves the extensions 44,46 away, disengaging them from the end of the confronting portion of the pump cylinder 16 so the ends 54,56 no longer abut the end of the confronting portion of the pump cylinder 16. As the lock 40 is slid upward, the resilient arms 48,50 are forced upward against the shoulder 76 of the body 12 causing the resilient arms 48,50 to bend into a flatter, more horizontal position than they are in when the sprayer 10 is in an inoperable position. The bending motion of the resilient arms 48,50 creates a restoring force in each resilient arms 48,50 causing the resilient arms 48,50 to work like a spring. The restoring force is maintained as long as an external force is applied to the projection 52 on the resilient arms 48,50 are flattened against the shoulder 76 of the body 12. When the external force is released and no longer applied to the projection 52, the restoring force causes the lock 40 to move to a lower position wherein the trigger lever 22 is in the inoperable state. This restoring force enables the trigger sprayer to be self-resetting.

To operate the sprayer of the first embodiment (FIGS. 1–4), the operator of the sprayer 10 grasps the trigger lever 22 with the hand while the trigger lever 22 is in its forwardly extended position and the extensions 44,46 are in abutting engagement with the confronting portion of the pump cylinder 16 as shown in FIG. 1. While the trigger lever 22 is grasped in this position, application of a slight upward force against projection 52, by shifting the operator's hand in the direction of the arrow in FIG. 2, slides the lock 40 in an upward direction viewed in FIG. 2. This upward shift of the lock 40 causes extensions 44,46 to slide upwardly and out of engagement with the confronting portion of the pump cylinder 16 against the bias of the resilient arms 48,50 and enables the trigger lever 22 to be actuated for pumping. The dual action of sliding the lock 40 upwardly while pulling the trigger lever 22 renders the sprayer 10 child-resistant.

When the lock 40 is slid upwardly, the resilient arms 48,50 are forced up against the shoulder 76 of the body 12 where they provide a constant downward restoring force against the lock 40. A slight restoring force may be present in the resilient arms 48,50 even when the lock 40 is in the lower position as shown in FIG. 1, but is increased when the projection 52 is pushed upward freeing the extensions 44,46 from the confronting portion of the pump cylinder 16. The restoring force provides a constant downward force on the lock 40 and tends to push the lock 40 back into a lower position on the trigger lever 22. This restoring motion enables the sprayer 10 to be self-resetting.

Upon release of the projection 25 and the trigger lever 22, the restoring force of the resilient arms 48,50 forces the lock 40 back to a lower position on the trigger lever 22 as shown in FIG. 1 wherein the extensions 44,46 once again abut the confronting portion of the pump cylinder 16 and thereby place the sprayer 10 in a locked position.

A second embodiment of the locking means 140 is illustrated in FIGS. 5–8. The locking means has a lock 140 that is slidingly mounted onto the trigger lever 122 similarly as described with reference to the first embodiment as illustrated in FIGS. 1–4.

Figure 5:
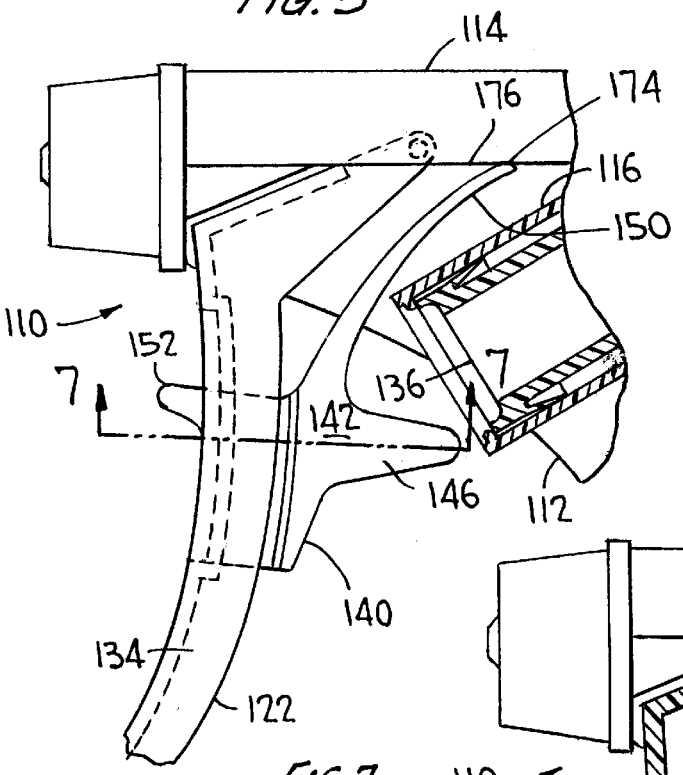
FIG. 5 is a partial side elevational view, partly broken-away, of a second embodiment of a self-resetting child-resistant trigger sprayer according to the invention with the trigger lever being shown in a locked position.

Referencing FIG. 5, as with the first embodiment, the trigger lever 122 is hingedly mounted to the body 112 so the trigger lever 122 will rotate about a hinge axis relative to the body 112 in this second embodiment of the present invention.

Figure 6:
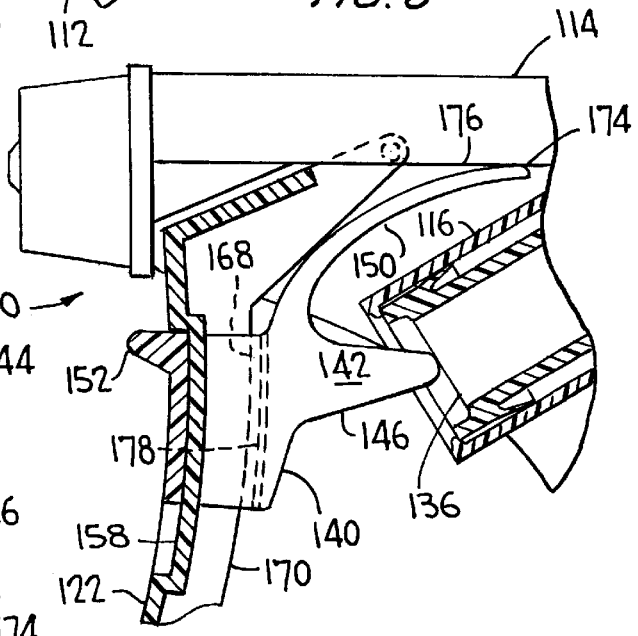
FIG. 6 is a view similar to FIG. 5, with the trigger lever being shown in an unlocked position.

A lock 140 is slidably mounted on the trigger lever 122 so the lock 140 will move in an up-and-down motion relative to the trigger lever 122. When the lock 140 is slid into an up position as shown in FIG. 6, the trigger lever 122 is placed in an unlocked position. If the lock 140 is moved into a lower position as shown in FIG. 5, the trigger lever 122 is placed in a locked position.

The lock 140 is comprised of a lock body 112 with extensions 144,146 extending out from the main portion of the body 142. A biasing means comprised of spring biased arcuate resilient arms 148,150 project out from the body 142 and extend upwardly. A projection 152 extends away from the main portion of the body 142, in a forward direction and allows for the lock 140 to be moved.

By sliding the lock 140 upwardly, the extensions 144,146 are moved away from the confronting portion of the piston rim 136 allowing the pump cylinder 116 to move freely. The trigger lever 122 is rendered locked when the extensions 144,146 rest against the confronting portion of the piston rim 136 preventing the pump cylinder 116 from moving. When in the locked position, the free end 172,174 of each resilient arm 148,150 rests against the shoulder 176 of the body 112 of the sprayer 110.

In FIG. 6, the lock 140 is retained in position on the trigger lever 122 by the coordinating relationship between the front portion 184 of the lock 140 being placed adjacent or abutting a center support 158 of the trigger lever 122 and the retaining projection 178 overlapping the rear sidewall edge 168,170 of the trigger lever 122. The overlapping of the retaining projections 178 prevents the lock 140 from slipping off the trigger lever 122 while the center support 158 keeps the lock 140 aligned with the trigger lever 122 so as to facilitate easy up-and-down movement of the lock 140 on the trigger lever 122.

When the trigger lever 122 is rendered inoperable by the lock 140, the extensions 144,146 rest against the confronting portion of the piston rim 136 preventing the pump cylinder 116 from moving. By sliding the lock 140 upwardly, the extensions 144,146 are moved away from the confronting portion of the piston rim 136 allowing the pump cylinder 116 to move freely.

When in the locked position, the free end 172,174 of each resilient arm 148,150 rests against a shoulder 176 which may be formed by a projection molded to the body 112 itself or by the shroud 114 overlying the body 112.

Figure 7:
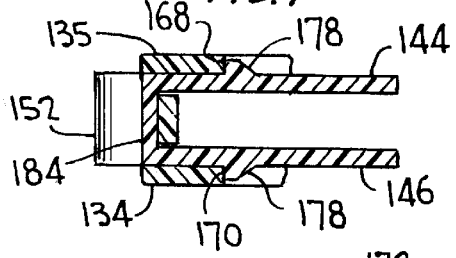
FIG. 7 is a cross-sectional view of the lock on the trigger lever of a second embodiment of a self-resetting child-resistant trigger sprayer taken along line 7—7 of FIG. 5.

The relationship between the lock 140 and the sidewalls 134,135 of the trigger lever 122 is illustrated in FIG. 7. When the lock 140 is attached to the trigger lever 122 (shown in FIGS. 5 & 6), the extensions 144,146 are placed between the sidewalls 134,135 of the trigger lever 122 with a center support 158 of the trigger lever 122 located between extension 144 and extension 146. Located on each side of the lock body 142 are retainer projections 178 that are used to secure the lock 140 into a position on the trigger lever 122. Each sidewall 134,135 of the trigger lever 122 is secured between the front portion 184 of the lock 140 and each retaining projection 178 locking the trigger lever 122 therebetween. Each retaining projection extends out past the rear sidewall edges 168,170 of each sidewall 134,135 thus preventing the lock 140 from sliding on the trigger lever sidewalls 134,135.

Figure 8:
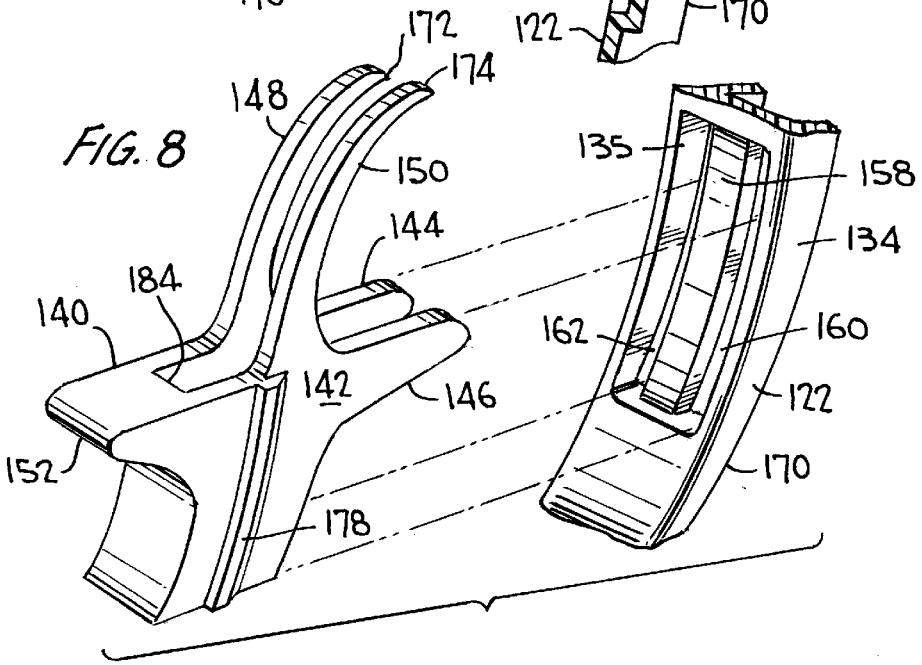
FIG. 8 is an exploded top perspective view partly broken-away showing the lock and a portion of the trigger lever of a second embodiment of the invention.

In FIG. 8, the lock 140 is shown before assembly to the trigger lever 122. To assemble the lock 140 onto the trigger lever 122 is an easy and convenient process wherein the lock 140 is slightly rotated so that the free ends 172,174 face forwardly. The free end 172,174 of each resilient arm 148,150 is placed through slots 160,162 in the trigger lever 122 first, with each resilient arm 148,150 following. When the free ends 172,174 have cleared the slots 160,162 on the opposite side of the trigger lever 122 from the insertion point, the lock 140 is then rotated back to an upright position with the free ends 172,174 coming to rest on the shoulder 176 as shown in FIG. 5 as the lock 140 is snapped into place on the trigger lever 122.

The lock 140 is snapped into position on the trigger lever 122 by pushing the remainder of the body 142 as close to the trigger lever 122 as possible until the retainer projection 178 on each side of the lock 140 is pushed past the rear sidewall edge 168,170 on each respective side. As each retainer projection clears the rear sidewall edge 168,170, the front portion 184 of the lock 140 is positioned against the center support 158 of the 122 and each retainer projection 178 snugly secures the lock 140 into place.

While the placement of the lock 140 onto the trigger lever 122 is easy and convenient in this embodiment, the trigger lever 122 is specially designed to facilitate the acceptance of this particular lock 140.

In operation, the operator of the sprayer 110 grips the trigger lever 122 with at least one finger on one hand. When the sprayer is not in use, the trigger lever 122 is in a forward position with the lock 140 and its projection 152 in a lower position on the trigger lever 122 while the extensions 144,146 of the lock 140 are pressing against the confronting portion of the piston rim 136. To deactivate the lock 144, the operator can slide the lock 140 upward by exerting an upward pressure on the projection 152, while simultaneously pulling the trigger lever 122 toward the pump piston 118. By sliding the projection 152 upward, the extensions 144,146 of the lock 140 are disengaged from the confronting portion piston rim 136 allowing the pair of extensions 144,146 to press against the piston rim 136 causing the pump cylinder 116 to move and activate the pumping action.

To return the sprayer 110 to an inoperable or locked position, the operator need only release the trigger lever 122 and release the projection 152 allowing it to return to a lower position on the trigger lever 122. The lock 140 will automatically return to a lower position on the trigger lever 122 because the restoring force of the resilient arms 148,150 will push the lock 140 in a downward direction when an resistence to such motion is released. When the lock 140 is returned to a lower position on the trigger lever 122, the extensions 144,146 return to a position abutting the confronting portion of the piston rim 136 essentially locking the sprayer 110 in an inoperable or locked position without any overt action by the operator. Due to the difficulty of performing a two-step function by a child of lifting the projection 152 while simultaneously pulling the trigger lever 122, the sprayer is rendered child-resistant while being self-resetting at the same time.

If the lock 140 is moved in an upward direction along the trigger lever 122, the resilient arms 148,150 are forced up against the shoulder 176 of the body 112 causing the resilient arms 148,150 to be manipulated or bent into a flatter, more horizontal position where a portion of the resilient arms 148,150 are parallel to the shoulder 176 of the body 112. The flattening motion of the resilient arms 148,150 creates a restoring force in each projection 148,150 causing a spring action to occur. When the pair of resilient arms 148,150 are flattened against the shoulder 176 of the body 112, they provide a constant downward restoring force that tries to push the lock 140 to a lower position on the trigger lever 122. The legs 148,150 remain in this altered position until the lock 140 is released and automatically moved back down to a lower position on the trigger lever 122.

By holding the projection 152 in the raised position, the resilient arms 148,150 remain bent and substantially flattened against the shoulder 176 of the body 112 while they are exerting a force to move the lock 140 back to a lower position wherein the trigger lever 122 is in the inoperable state.

The restoring force of the resilient arms 148,150 against the shoulder 176 enables the sprayer 110 to be self-resetting. When the projection 152 is no longer held in a raised position, the resilient arms 148,150 force the lock 140 to slidably move down the trigger lever 122 and reset itself back into a locked or inoperable position.

Some of the similarities between the two embodiments are that in both versions, the lock is slidingly attached to the trigger lever. Another similarity is that each embodiment has a pair of spring-biased legs that create a restoring force enabling the sprayer to be self-resetting. A two-step action is required to operate the sprayer in both embodiments providing for the sprayer to be child-resistant.

A few of the differences between the two embodiments are that the lock in the first embodiment is capable of being used with a conventional trigger lever thereby not requiring special trigger levers to be manufactured whereas in the second embodiment a trigger lever modified to include slots must be used in conjunction with the lock. In the first embodiment, the conventional tup of the sprayer is used to engage the piston rim, while in the second embodiment, the lock has a plurality of extensions located thereon that are used to engage the piston rim.

Although particular embodiments of the invention have been described in detail herein with reference to the accompanying drawings, it is to be understood that the invention is not limited to those precise embodiments, and that various changes and modifications are possible. Some foreseeable alternative embodiments may include biasing means that could be located below the tup of the sprayer instead of above as in the first embodiment thereby allowing the lock to be moved in a downward direction instead of upwardly. The biasing means could be a tension means instead of a compression means which also would allow the lock to be slid in a downwardly direction along the trigger lever instead of an upwardly direction as currently described. Also, the tup of the trigger lever could be connected, such as by a snap-fit engagement or other known connecting means, to the pump piston thereby eliminating the need for a separate piston return spring. The biasing means of the lock would thus function as an external piston return spring. Such changes and modifications may be effected by one skilled in the art without departing from the scope or spirit of the invention as defined in the appended claims.

What is claimed is:

1. A locking body for use with a self-resetting child-resistant trigger operated sprayer comprising:

a one-piece structure including a front portion, a rear portion and a pair of side portions spaced from one another;

said front portion including a projection extending forwardly of said body;

said side portions being interconnected at said forward portion of said body and extending rearwardly from said forward portion in substantially parallel relationship to one another;

said side portions including a pair of spaced resilient arms having upper ends adapted to abut against shoulders on a sprayer;

said side portions having ends at said rear portion adapted to engage a pump body of a sprayer;

said side portions having retainer projections extending laterally therefrom and being adapted to engage a trigger lever of a pump sprayer.

2. The locking body according to claim 1, wherein:

said retainer projections extend inwardly toward one another from said side portions.

3. The locking body according to claim 1, wherein:

said retainer projections extend outwardly from said side portions.

4. The locking body according to claim 1, wherein:

said resilient arms are of arcuate configuration.

5. The locking body according to claim 1, wherein:

said ends of said side portions extend inwardly toward one another.

6. A self-resetting child-resistant sprayer comprising:

a pump body;

a trigger lever pivotally mounted at an upper end thereof to said pump body, said trigger lever having a lower free end and a forward finger engaging surface extending between said ends;

a locking means supported on said trigger lever for preventing trigger actuation in a first position of said locking means;

said locking means having a portion thereof in abutting engagement with a confronting portion of said pump body in said first position;

said locking means having biasing means and being slidingly mounted on said trigger lever;

said locking means having a projection extending forwardly of said finger engaging surface to provide for manually sliding of said locking means against the bias of said biasing means from said first position to a second position in which said extension is out of engagement with said confronting portion of said pump body to permit trigger lever actuation, said biasing means automatically returning said locking means to said first position.

7. A self-resetting child-resistant sprayer comprising:

a pump body;

a trigger lever pivotally mounted at an upper end thereof to said pump body, said trigger lever having a forward finger engaging surface extending between said ends;

said trigger lever having an opposing free end and rearwardly extending means intermediate said ends for actuating said sprayer upon manual operation of said trigger lever;

a locking means supported on said trigger lever for preventing trigger actuation in a first position of said locking means;

said locking means having a portion thereof in abutting engagement with a confronting portion of said pump body in said first position;

said locking means being slidingly mounted on said trigger lever;

said locking means having biasing means for urging said locking means toward said first position;

said locking means having a projection extending forwardly of said finger engaging surface for manually sliding said locking means against the bias of said biasing means from said first position to a second position in which said extension is out of engagement with said confronting portion of said pump body to permit trigger actuation, said biasing means automatically returning said locking means to said first position.

8. The locking body according to claim 7, wherein:

said locking means has retainer projections extending inwardly toward one another for retaining said locking means on said trigger lever.

9. The locking body according to claim 8, wherein:

said biasing means are resilient arms of arcuate configuration.

10. The locking body according to claim 9, wherein:

said biasing means is integral with said locking means.

11. The locking body according to claim 10, wherein:

said locking means has a plurality of extensions, each extension having an end extending inwardly.

12. A self-resetting child-resistant sprayer comprising:

a pump body;

a trigger lever pivotally mounted at an upper end thereof to said pump body, said trigger lever having a forward finger engaging surface extending between said ends;

a locking means supported on said trigger lever for preventing actuation of said sprayer in a first position of said locking means and for actuating said pump dispenser in a second position of said locking means;

said locking means having an extension in abutting engagement with a confronting portion of said pump body in said first position and being slidingly mounted on said trigger lever;

said trigger lever having at least one slot therein for slidingly receiving said locking means;

said locking means having biasing means;

said biasing means automatically returning said locking means to said first position; and said locking means having a projection extending forwardly beyond said finger engaging surface to provide for manually sliding of said locking means against the bias of said biasing means from said first position to a second position in which said extension is out of engagement with said confronting portion of said pump body to permit trigger actuation.

13. The locking body according to claim 12, wherein:

said retainer projections extend outwardly from said side portions away from one another.

14. The locking body according to claim 13, wherein:

said biasing means are resilient arms of arcuate configuration.

15. The locking body according to claim 14, wherein:

said biasing means is integral with said locking means.

* * * * *